US005964250A

United States Patent [19]

Mueller

[11] Patent Number: 5,964,250

[45] Date of Patent: Oct. 12, 1999

[54] LOW LEAKAGE, ARTICULATING FLUID TRANSFER TUBE

[75] Inventor: Peter W. Mueller, Morrow, Ohio

[73] Assignee: General Electric Company, Cincinnati, Ohio

[21] Appl. No.: 08/982,003

[22] Filed: Dec. 1, 1997

[51] Int. Cl.[6] ..... F16L 9/22

[52] U.S. Cl. ..... 138/109; 138/155; 138/178; 285/9.2; 285/279

[58] Field of Search ..... 138/178, 155, 138/109, 45; 285/9.2, 279, 267, 268, 269, 316

[56] References Cited

U.S. PATENT DOCUMENTS

| | | | |
|---|---|---|---|
| 1,604,868 | 10/1926 | Woodruff | 285/267 |
| 1,872,666 | 8/1932 | Brownell | 285/279 |
| 2,876,876 | 3/1959 | Cummins . | |
| 3,130,747 | 4/1964 | Benaway | 138/42 |
| 3,449,937 | 6/1969 | Dimmig | 138/109 |
| 3,674,014 | 7/1972 | Tillander | 138/155 |
| 3,836,083 | 9/1974 | Bell | 138/45 |
| 4,610,483 | 9/1986 | Matsumoto et al. . | |
| 5,109,888 | 5/1992 | Usui | 138/109 |
| 5,152,587 | 10/1992 | Volz . | |
| 5,396,918 | 3/1995 | Parker | 138/45 |
| 5,577,775 | 11/1996 | Pearson et al. | 285/279 |

FOREIGN PATENT DOCUMENTS

| | | |
|---|---|---|
| 1231337 | 9/1960 | France . |
| 308680 | 5/1930 | United Kingdom . |

*Primary Examiner*—Denise L. Ferensic
*Assistant Examiner*—James F. Hook
*Attorney, Agent, or Firm*—Andrew C. Hess; Rodney M. Young

[57] ABSTRACT

A transfer tube system includes a transfer tube, a spring, a pair of opposing seats, and a pair of end assemblies that provide independent axial spring loading of the opposing seats. The spring loading assures continuous sealing contact regardless of dynamic loading, dimensional stack-up, or geometry change resulting from interfaced wear. The transfer tube end assemblies include a spherical or conical seat for mating with the transfer tube. Particularly, the transfer tube has spherical ends for seating in the transfer tube end assembly seats. The conical/spherical seats permit angular motion of interfacing components without lift off and therefore assures minimal leakage.

20 Claims, 2 Drawing Sheets

LOW LEAKAGE, ARTICULATING FLUID TRANSFER TUBE

FIELD OF THE INVENTION

This invention relates generally to gas turbine engines and, more particularly, to transfer tubes utilized in connection with such engines.

BACKGROUND OF THE INVENTION

Transfer tubes often are utilized in aircraft engines to transmit engine air having one temperature and pressure from one chamber to another chamber physically removed from the one chamber. The transfer tube may span a third chamber having a different air temperature and pressure than the air temperature and pressure in the transfer tube, and the air in the transfer tube should be isolated from the air in the third chamber. Generally, the objective is to move the air from the first chamber into the second chamber without leaking the air into the third chamber.

To achieve this objective, the transfer tube typically is placed into and maintained in intimate contact with interface seats at the first and second chamber. The interface contact, however, has to avoid wear from differential motion which could cause leakage and rattle induced vibratory distress. The interface requirements of minimal leakage and vibratory integrity are in conflict with the requirements of low interface wear and of allowing differential motion between the transfer tube ends.

Satisfying the interface requirements often is achieved by off-optimizing each individual requirement. These compromises often result in less than desired transfer tube mission life and sealing performance. It would be desirable to provide a transfer tube connection which minimizes leakage and wear yet provides maximum differential motion and vibratory integrity.

SUMMARY OF THE INVENTION

These and other objects may be attained by a system including transfer tube and end assemblies which provide independent axial spring loading of opposing seats to assure continuous sealing contact regardless of dynamic loading, dimensional stack-up or geometry change resulting from interfaced wear. More particularly, and in one embodiment, a first transfer tube end assembly includes a fitting having a first interface end and a second interface end. First interface end may, for example, be bolted to a surface of a gas turbine engine. Second interface end is bolted to a transfer tube fitting. A bore extends through the fitting, and a transfer tube seat is sized to be at least partially located within the bore. The transfer tube seat is spring loaded in that a spring is positioned within the bore and exerts a force against the seat to push the seat into contact with the transfer tube.

The second transfer tube end assembly also includes a spherical or conical seat for mating with the transfer tube. Particularly, the transfer tube has spherical ends for seating in the transfer tube end assembly seats. The conical/spherical seats permit angular motion of interfacing components without lift off and therefore assure minimal leakage. In addition, the axial seating force between the transfer tube and the seats is provided by the spring which assures contact over the breadth of operational inertial loadings. The conical/spherical seats in combination with the spring loading assure seating contact across all expected differential motions, i.e., axial, radial and rotation motion. All leak paths are closed and transfer tube contact is maintained against any expected wear or dimensional stack-up or dynamic unseating.

DETAILED DESCRIPTION

Figure 1:
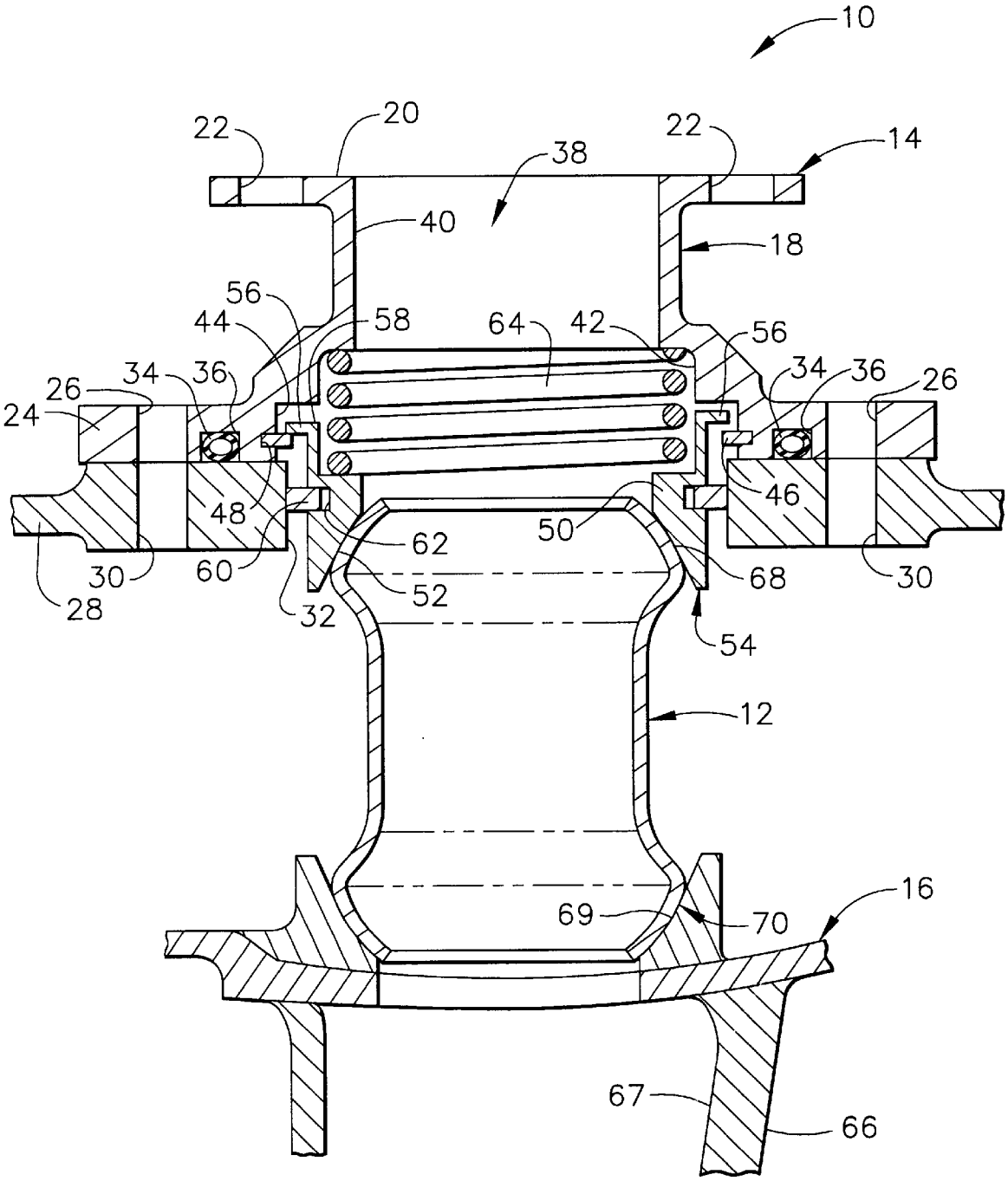
FIG. 1 is a cross sectional view of a transfer tube and associated connections in accordance with one embodiment of the present invention.

FIG. 1 is a cross sectional view of a system 10 including a transfer tube 12 and associated transfer tube end assemblies 14 and 16 in accordance with one embodiment of the present invention. Transfer tube end assembly 14 includes a fitting 18 having a first interface end 20 having bolt openings 22 and a second interface end 24 having bolt openings 26. First interface end 20 may, for example, be bolted to a surface of a gas turbine engine. Second interface end 24 is bolted to a transfer tube fitting 28 having bolt openings 30 and a transfer tube opening 32 therethrough. A gasket 34, located in a gasket groove 36 in second interface end 24, forms a seal with transfer tube fitting 28.

A bore 38 extends through fitting 18, and bore 38 has a first bore section 40, a second bore section 42, and a third bore section 44. Second bore section 42 has a diameter greater than the diameter of first bore section 40, and third bore section 44 has a diameter greater than the diameter of second bore section 42. A snap ring 46 is located in a groove 48 in a surface of third bore section 44, and snap ring 46 serves as a stop as described below in more detail.

A transfer tube seat 50 is sized to be at least partially located within third bore section 44, and seat 50 includes a conical, or spherical, seat 52 on an inner diameter surface at a first end 54 and a stop arm 56 at a second end 58. A piston ring 60 is secured within a groove 62 which extends around an outer diameter surface of seat 50, and piston ring 60 cooperates with transfer tube fitting 28 to form a seal. Transfer tube seat 50 is spring loaded in that a spring 64 is positioned within bore 38 and exerts a force against seat 50 to push seat 50 into contact with transfer tube 12. Stop arm 56 cooperates with snap ring 48 to prevent separating seat 50 from fitting 18.

Transfer tube end assembly 16 comprises a fitting 66 having a bore 67 extending therethrough and a spherical or conical seat 69 for mating with transfer tube 12. Transfer tube 12, which may be machined or formed of sheet metal, has spherical ends 68 and 70 for seating in transfer tube end assembly seats 50 and 69. Tube ends 68 and 70 may be coated to minimize differential motion induced wear. Spherical transfer tube ends 68 and 70 seat on precisely machined, conical/spherical seats 52 and 69, which permit angular motion of interfacing components without lift off and therefore assures minimal leakage. Axial seating force between transfer tube 12 and seats 50 and 69 is provided by spring 64 which assures contact over the breadth of operational inertial loadings. Conical/spherical seats 52 and 69 in combination with spring loading assures seating contact across all expected differential motions, i.e., axial, radial and rotation motion. All leak paths are closed and transfer tube contact is maintained against any expected wear or dimensional stack-up or dynamic unseating by the wear compensating, independently spring loaded external transfer tube removable end assembly 14.

The above described system combines the advantages of the spherically ended transfer tube, appropriately coated or having selected materials which minimize wear, with independent axial spring loading of the opposing seats which assures continuous sealing contact regardless of dynamic loading, dimensional stack-up or geometry change resulting from interfaced wear. Vibratory loading induced wear is substantially eliminated through proper selection of the axial seating spring force. The spring load force should be selected to exceed the expected dynamic inertial unseating force. The spring loading of the seats provides axial rather than radial seating of the transfer tube. The spring also is independent of stack-up and wear and therefore provides constant axial force.

Interfaces external to system 10 can be of any type, e.g., sliding or fixed. In addition, any material combination or sealing combination allowing transfer tube seating independent of its sealing functions and which assures dynamic seating independent of sealing functions at all conditions while permitting large relative motion between either sealing end of the transfer tube, could be utilized.

Figure 2:
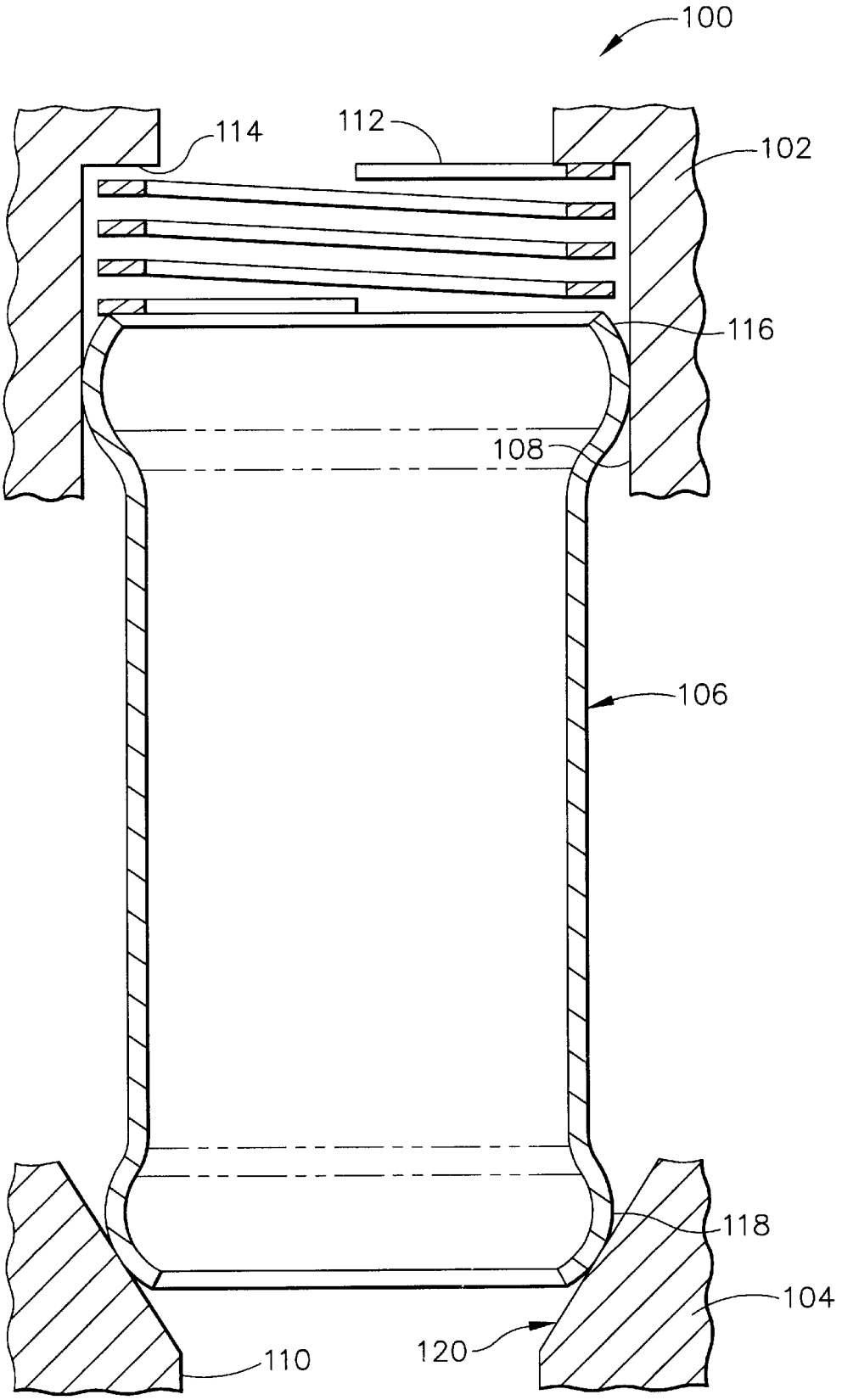
FIG. 2 is a cross section view of another transfer tube and associated connections in accordance with another embodiment of the present invention.

For example, FIG. 2 is a cross section view of another system 100 including end assemblies 102 and 104 and a transfer tube 106. Each assembly 102 and 104 includes a bore 108 and 110. A spring 112 is positioned in bore 108 and is compressed between a ledge 114 and an end 116 of tube 106. End 118 of tube 106 is seated on a spherical or conical seat 120. End 118 is spherical or conical so that a seal is formed between end 118 and the walls of seat 120. End 116 is spherical and fits tight in bore 108 of end assembly 102. For minimal leakage between end 116 and bore 108, the diametral fit should be near zero, or zero. Any diametral clearance between end 116 and bore 108 represents potential for wear, except that spring 112 exerts a force against tube 106 so that tube end 118 remains positioned on seat 120 and tube end 116 is therefore restrained against random dithering against bore 108. End 116 in bore 108 is limited to rotational excursions in magnitude less than that required to unseal end 116 from bore 108. Spring 112 exerts a force against tube 106 so that tube end 118 remains positioned on seat 118. Many of the same advantages provided by system 10 also are provided by system 100.

System 100 is believed to be easier and more simple to implement than system 10. System 10, however, has no displacement and seals fully at all levels of motion. Both systems 10 and 100 are vibration proof in that the axial spring force always seats the tube.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

I claim:

1. A transfer tube system, comprising:

a transfer tube;

a first transfer tube end assembly comprising a fitting having a bore extending therethrough, one end of said transfer tube positioned in said first assembly bore, and a spring located in said bore and exerting a force against said transfer tube; and a second transfer tube end assembly comprising a seat, one end of said transfer tube located in said second assembly seat, said spring contacting said seat to apply a force on said transfer tube.

2. A transfer tube system in accordance with claim 1 wherein said ends of said transfer tube have a spherical shape and form seals with surfaces of said first assembly bore and said second assembly seat.

3. A transfer tube system in accordance with claim 2 wherein said spring is in direct contact with said transfer tube.

4. A transfer tube system in accordance with claim 1 wherein said first transfer tube end assembly further comprises a seat, said seat comprising a seating surface and said one end of said transfer tube seated on said seating surface, said spring in direct contact with said seat.

5. A transfer tube system in accordance with claim 4 wherein said seat further comprises a stop arm for preventing said seat from separating from said first end assembly fitting.

6. A transfer tube system in accordance with claim 4 wherein said first assembly seat is spherical.

7. A transfer tube system in accordance with claim 4 wherein said first assembly seat is conical.

8. A transfer tube system in accordance with claim 1 further comprising a transfer tube fitting, said transfer tube fitting secured to said first assembly fitting, said transfer tube fitting having an opening therethrough, said transfer tube extending through said transfer tube fitting opening.

9. A transfer tube system in accordance with claim 8 further comprising a ring, wherein said first transfer tube end assembly further comprises a seat, said ring secured to said seat for forming a seal between said seat and said fitting.

10. A transfer tube system in accordance with claim 1 wherein said first end assembly fitting further comprises a first interface end and a second interface end, said first interface end comprising a plurality of bolt openings.

11. A transfer tube system in accordance with claim 1 wherein said first end assembly fitting comprises a bore having a first bore section, a second bore section, and a third bore section, said second bore section having a diameter greater than a diameter of said first bore section, and said third bore section having a diameter greater than said second bore section diameter.

12. A transfer tube system, comprising:

a transfer tube;

a first transfer tube end assembly comprising a fitting having a bore extending therethrough, a seat comprising a seating surface, one end of said transfer tube positioned in said first assembly bore and seated on said seating surface, and a spring located in said bore and exerting a force against said seat to maintain said transfer tube seated on said seating surface;

a transfer tube fitting secured to said first assembly fitting, said transfer tube fitting having an opening therethrough, said transfer tube extending through said transfer tube fitting opening; and a second transfer tube end assembly comprising a seat, one end of said transfer tube located in said second assembly seat.

13. A transfer tube system in accordance with claim 12 wherein said ends of said transfer tube have a spherical shape.

14. A transfer tube system in accordance with claim 12 wherein said seat further comprises a stop arm for preventing said seat from separating from said first end assembly fitting.

15. A transfer tube system in accordance with claim 12 wherein said first assembly seat is spherical.

16. A transfer tube system in accordance with claim 12 wherein said first assembly seat is conical.

17. A transfer tube system in accordance with claim 12 wherein said first end assembly fitting further comprises a first interface end and a second interface end, said first interface end comprising a plurality of bolt openings.

18. A transfer tube system in accordance with claim 12 wherein said first end assembly fitting comprises a bore having a first bore section, a second bore section, and a third bore section, said second bore section having a diameter greater than a diameter of said first bore section, and said third bore section having a diameter greater than said second bore section diameter.

19. A transfer tube system in accordance with claim 12 further comprising a ring secured to said seat, said ring cooperating with said transfer tube fitting to form a seal between said seat and said fitting.

20. A transfer tube system in accordance with claim 12 wherein said spring contacts said seat and exerts a force on said seat.

* * * * *